US007086444B2

(12) United States Patent
Nien

(10) Patent No.: US 7,086,444 B2
(45) Date of Patent: Aug. 8, 2006

(54) SLAT ASSEMBLY FOR BLIND

(76) Inventor: Leslie Nien, No. 45-4, Fan Po St., Fu Hsing Hsiang, Changhua Hsien (TW)

( * ) Notice: Subject to any disclaimer, the term of this patent is extended or adjusted under 35 U.S.C. 154(b) by 0 days.

(21) Appl. No.: 10/855,742

(22) Filed: May 28, 2004

(65) Prior Publication Data

US 2005/0167057 A1 Aug. 4, 2005

(30) Foreign Application Priority Data

Jan. 30, 2004 (TW) ..... 93201375 U

(51) Int. Cl.
*E06B 9/386* (2006.01)

(52) U.S. Cl. ..... 160/236; 160/230

(58) Field of Classification Search ..... 160/236, 160/232, 235, 173 R, 173 V, 230, 231.1, 160/231.2; 49/92.1
See application file for complete search history.

(56) References Cited

U.S. PATENT DOCUMENTS

| | | | | |
|---|---|---|---|---|
| 2,244,300 | A * | 6/1941 | Kwon | 160/196.1 |
| 2,724,434 | A * | 11/1955 | Smith | 160/348 |
| 4,884,615 | A * | 12/1989 | Hsu | 160/236 |
| 5,263,529 | A * | 11/1993 | Landis | 160/236 |
| 5,896,903 | A * | 4/1999 | Chen et al. | 144/350 |
| 6,192,949 | B1 * | 2/2001 | Nien | 144/350 |
| 6,276,429 | B1 * | 8/2001 | Chen | 160/231.1 |
| 6,378,567 | B1 * | 4/2002 | Chen | 139/383 R |
| 6,622,763 | B1 * | 9/2003 | Chen | 144/350 |

FOREIGN PATENT DOCUMENTS

EP 0505661 * 9/1992

* cited by examiner

*Primary Examiner*—David Purol
(74) *Attorney, Agent, or Firm*—Troxell Law Office, PLLC

(57) ABSTRACT

A slat assembly for blind includes a plurality of support rods that are sequentially lined up side by side in abutment with an adhesive glue layer coated at the bottom side thereon for a woven fabric of various diagrams and designs to be attached thereto wherein, via the fastening of the adhesive glue layer thereof, the weaving spots of the woven fabric and the adjacent joints of the juxtaposed support rods thereof are securely bound together to form a rigid and straight piece of decoration article that is capable of being further cut in equal space into a plurality of slat pieces each having a cord passage hole disposed at both lateral sides thereon respectively to form a horizontal-type slat piece, or a hook hole disposed at one lateral side thereon to provide a vertical-type slat piece thereof. Thus, when the slat pieces are turned or rolled, the support rods and the woven fabric disposed at both top and bottom sides thereof will be variously displayed in diagrams and colors to achieve special visual effects of the blind assembly thereof. Besides, via the adhesive glue layer, the woven fabric is securely bound with the support rods, efficiently avoiding the loose yarns in the cutting operation thereof.

8 Claims, 6 Drawing Sheets

SLAT ASSEMBLY FOR BLIND

BACKGROUND OF THE INVENTION

The present invention is related to a slat assembly for blind, including a plurality of support rods that are sequentially lined up side by side in abutment with an adhesive glue layer coated at the bottom surface thereon for a woven fabric of various diagrams to be attached thereto wherein, via the fastening of the adhesive glue layer thereof, the weaving spots of the woven fabric and the adjacent joints of the juxtaposed support rods thereof are securely bound together to form a rigid and straight piece of decoration article which is capable of being cut in equal space to provide a plurality of slat pieces; whereby, when the slat pieces are turned or rolled, the support rods and the woven fabric displayed at both top and bottom sides thereof will be variously displayed in diagrams and colors to achieve special visual effects of the slat assembly thereof.

A conventional slat assembly for blind is made up of slat pieces which are molded via plastics into elongated and slim solid slat pieces of sufficient strength and hardness before diagrams are printed or hot-pressed onto the surfaces of the horizontal-type or vertical-type slat pieces respectively to increase the beauty of the blind assembly in display. Finally, cord passage holes are punched at the slat pieces thereon for retaining cords to be led there-through.

There are some drawbacks to such conventional slat assembly for blind. First, the horizontal-type or vertical-type slat pieces, made of plastics, must be individually formed via injection molding, which is complicated in the process and thus difficult to produce the slat pieces quickly on a massive scale. Besides, the slat pieces must be further processed via printing or hot-pressing to apply the diagrams onto the surfaces thereof, which may boost the cost of production and is rather uneconomical in efficiency. Second, after long time of repeated friction of the slat pieces in use, the diagrams printed thereon can easily come or wear off, which not only mars the overall beauty of the blind, but also reduces the using lifespan of the slat pieces thereof. Third, the horizontal-type or vertical type slat pieces, made of plastics, can increase the burden of the environment in recycle. When burned off in disposal, the slat pieces thereof can also cause air pollution and harm the environment.

SUMMARY OF THE PRESENT INVENTION

It is, therefore, the primary purpose of the present invention to provide a slat assembly for blind, including a plurality of support rods that are sequentially lined up side by side with an adhesive glue layer coated at the bottom surface thereon for a woven fabric to be securely attached thereto to form a rigid and straight piece of decoration article which is capable of being cut in equal space to provide a plurality of slat pieces with woven diagrams and colorful patterns displayed thereon, facilitating a fast and easy processing thereof so as to reduce the cost of production and achieve economical efficiency thereof.

It is, therefore, the second purpose of the present invention to provide a slat assembly for blind wherein, when the slat pieces are turned or rolled, the support rods and the woven fabric disposed at both top and bottom sides thereof will be variously displayed in diagrams and colors to achieve special visual effects thereof. Besides, via the fastening of the adhesive glue layer, the weaving spots of the woven fabric and the adjacent joints of the juxtaposed support rods are securely bound together, efficiently avoiding the loose yarns in the cutting operation thereof.

It is, therefore, the third purpose of the present invention to provide a slat assembly for blind wherein the slat pieces, made up of the support rods of bamboo materials, the woven fabric, and the adhesive glue layer of food-used fastening agent, are easily disposed of in recycle or burning off without causing any burden or air pollution to the environment to provide an eco-friendly slat pieces thereof.

DETAILED DESCRIPTION OF THE PREFERRED EMBODIMENTS

Figure 3:
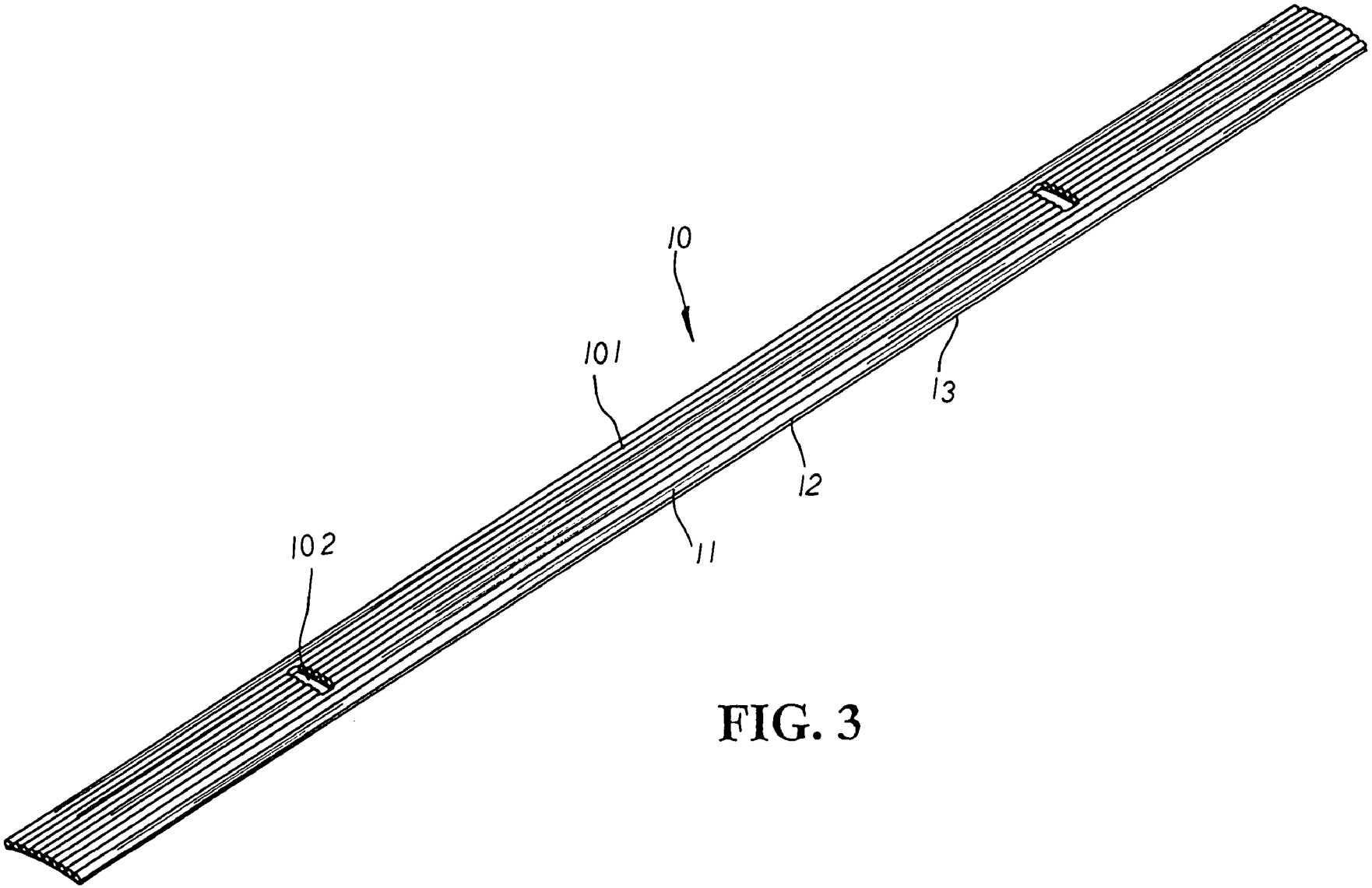
FIG. 3 is a perspective view of a horizontal-type slat piece of the present invention.
Figure 4:
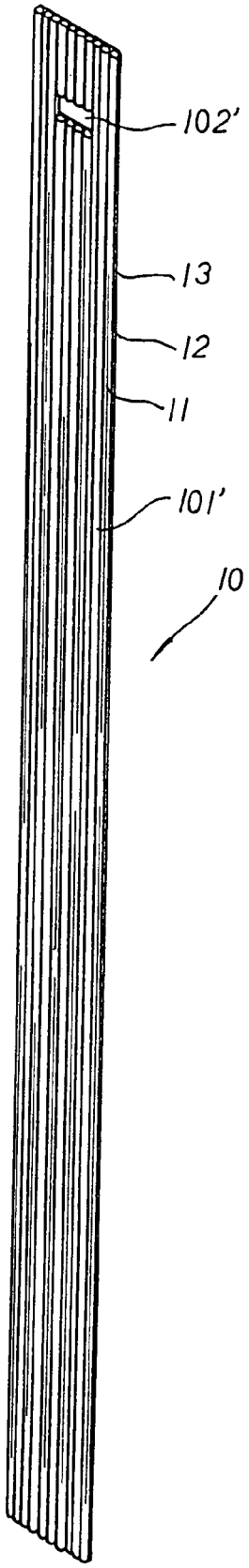
FIG. 4 is a perspective view of a vertical-type slat piece of the present invention.

Please refer to FIGS. 1 to 4 inclusive. The present invention is related to a slat assembly for blind, including a plurality of support rods 11 of bamboo material that are sequentially lined up side by side in abutment wherein the support-rods 11 thereof can be made in round column shapes. A food-used and transparent adhesive glue layer 12 is coated at the bottom surface of the juxtaposed support rods 11 thereon for a woven fabric 13 of various diagrams and designs to be attached thereto. Via the fastening of the adhesive glue layer 12 thereof, the weaving spots of the woven fabric 13 and the adjacent joints of the juxtaposed support rods 11 are securely bound together to form a rigid and straight piece of decoration article 10 which is capable of being further cut in equal space into a plurality of slat pieces 101 of a preset size. Both lateral sides of each slat piece 101 thereof can be disposed with a cord passage hole 102 respectively for a retaining cord to be led there-through to provide a horizontal-type slat piece 101 as shown in FIG. 3. Otherwise, the decoration article 10 can also be equidistantly cut into a plurality of slat pieces 101' each having a hook hole 102' disposed at one lateral side thereon to form a vertical-type slat piece 101' as shown in FIG. 4. Thus, when the slat pieces 101, 101' thereof are turned or rolled, the support rods 11 and the woven fabric 12 disposed at both top and bottom sides of the slat pieces 101, 101' thereon will be variously displayed in diagrams and colors to achieve special visual effects of the slat assembly thereof. Besides, via the adhesive glue layer 12 thereof, the woven fabric 13 is securely bound with the support rods 11 thereof, efficiently avoiding the loose yarns in the cutting operation thereof.

Figure 1:
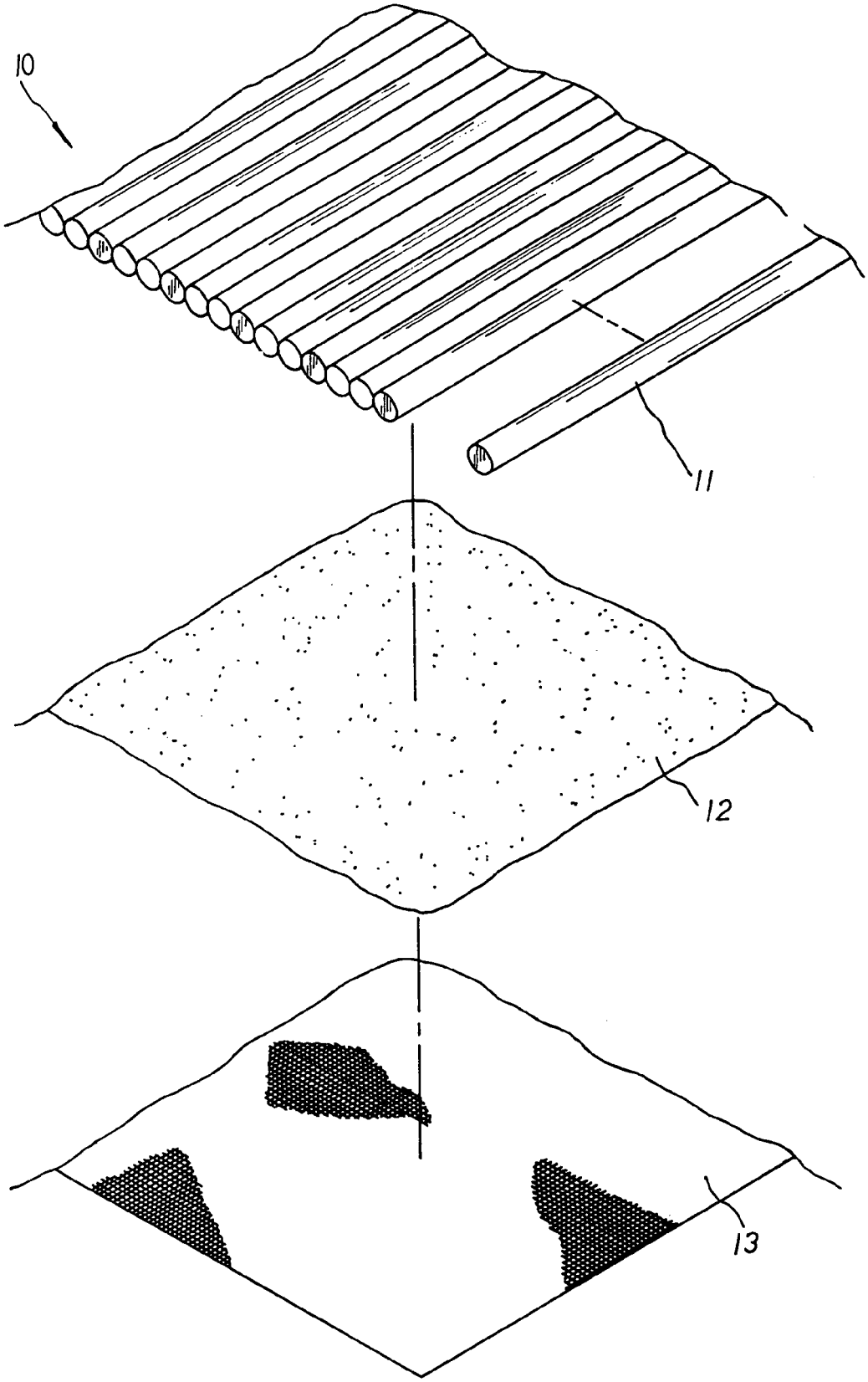
FIG. 1 is a perspective exploded view of the present invention.
Figure 2:
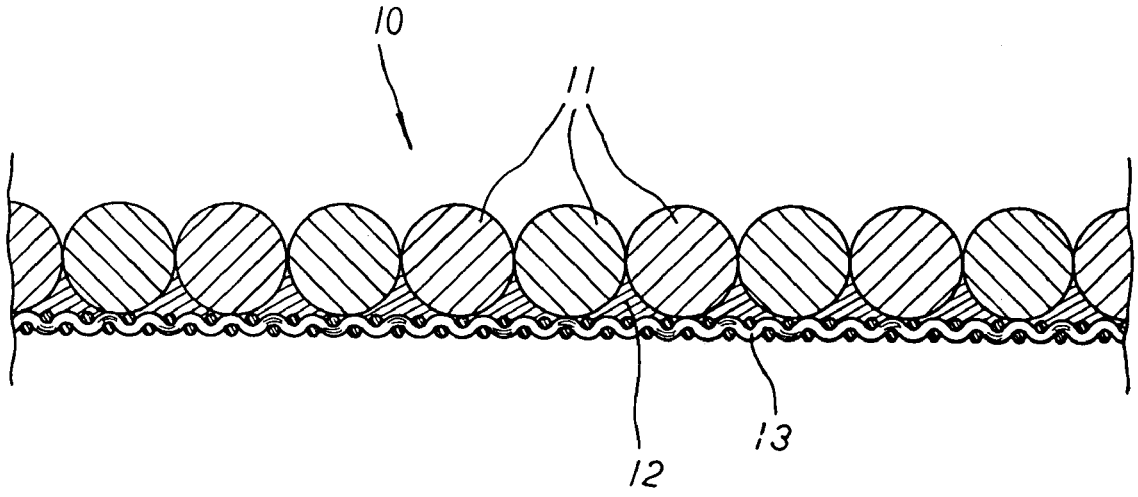
FIG. 2 is a cross sectional view of the present invention in assembly.
Figure 6:
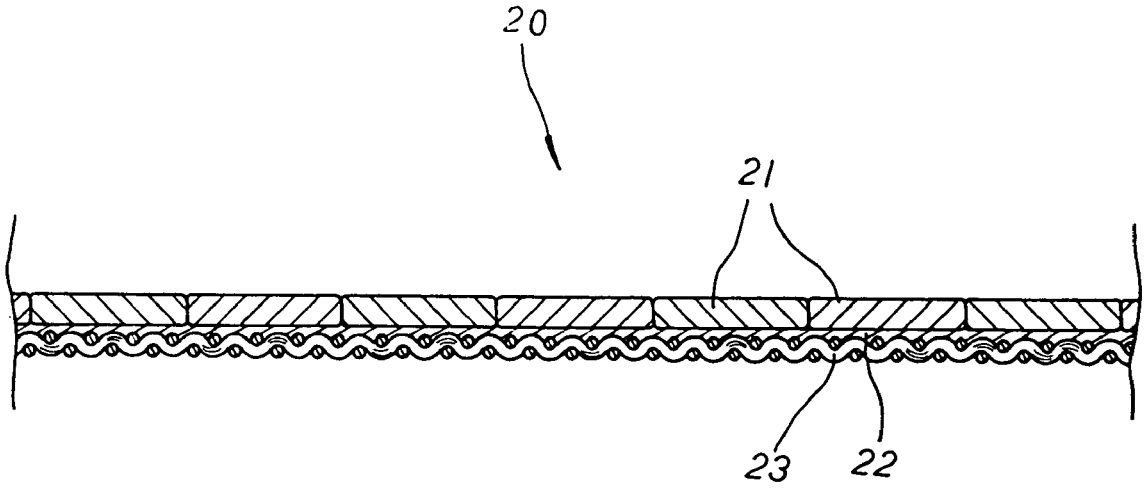
FIG. 6 is a cross sectional view of another embodiment of the present invention.
Figure 5:
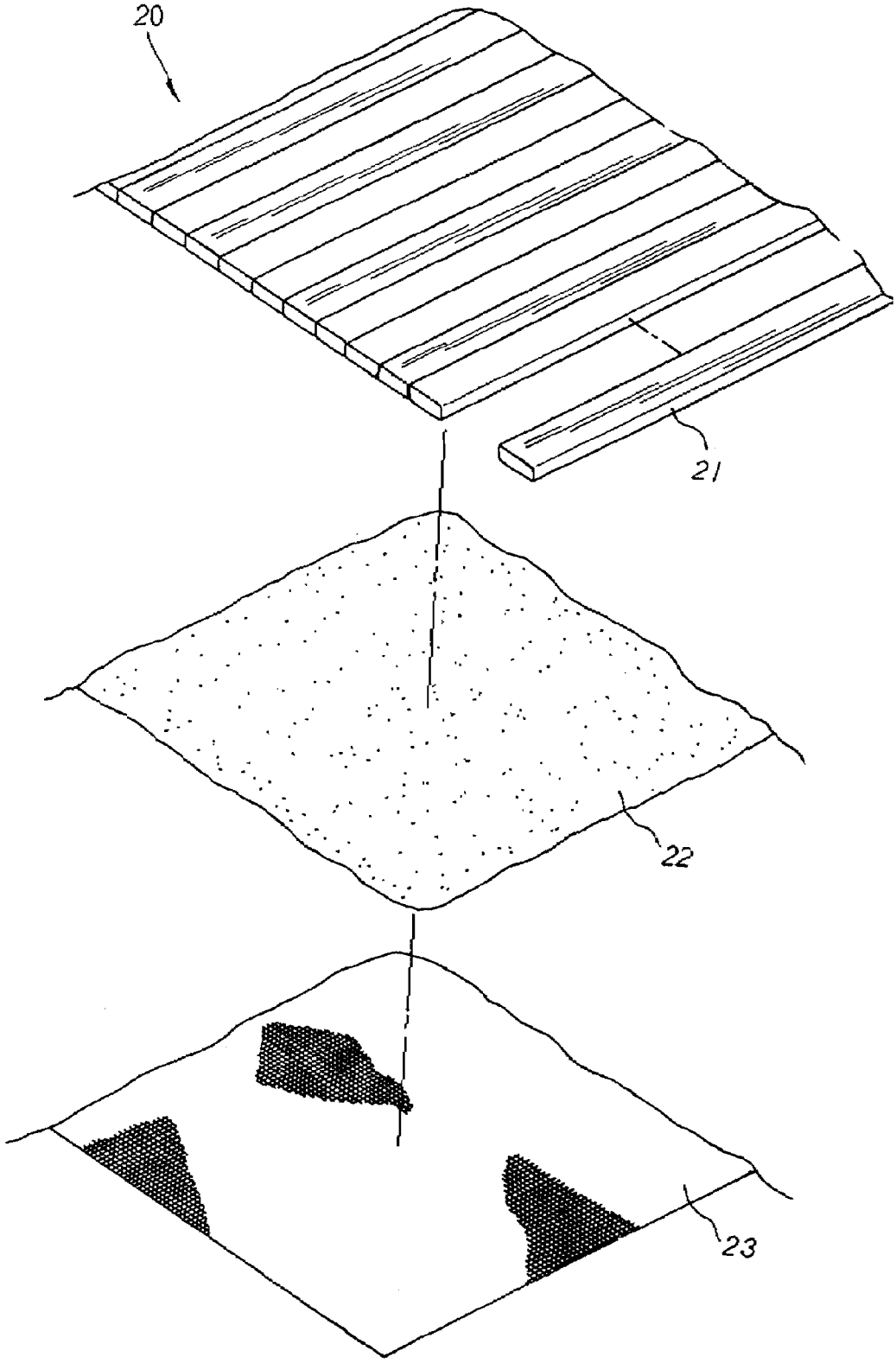
FIG. 5 is a perspective exploded view of another embodiment of the present invention.

Please refer to FIGS. 5 to 6 inclusive. The present invention can also have a plurality of support rods 21 made in elongated and slim board-like shapes that are sequentially lined up side by side in abutment with an adhesive glue layer 22 coated at the bottom surface thereon for a woven fabric 23 of various diagrams and designs to be attached thereto.

Thus, the weaving spots of the woven fabric 23 and the adjacent joints of the support rods 21 thereof are securely bound together by the adhesive glue layer 22 to form a rigid and straight piece of decoration article 20 thereby.

Figure 7:
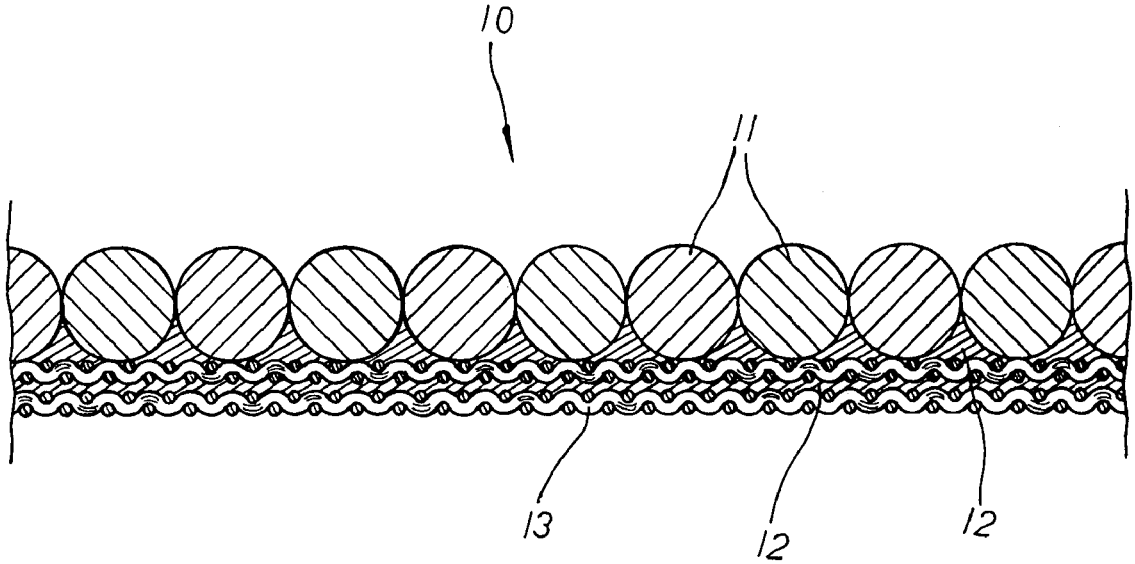
FIG. 7 is a cross sectional view of a third embodiment of the present invention.

Please refer to FIG. 7. The woven fabric 13, 23 attached to the decoration articles 10, 20 thereof can also be made up of one or more than one layers that are mutually fastened together via the adhesive glue layer 12, 22 coated there-between.

What is claimed is:

1. A slat assembly for a blind comprising:

a slat having:

a) a plurality of support rods, each of the plurality of support rods having at least one longitudinal edge aligning with a longitudinal edge of an adjacent one of the plurality of support rods;

b) an adhesive glue layer coating an entire upper surface of each of the plurality of support rods and gaps between adjacent rods of the plurality of support rods; and c) a woven fabric covering the entire upper surface of each of the plurality of support rods and connected thereto by the adhesive glue layer.

2. The slat assembly according to claim 1, wherein the plurality of support rods are made of bamboo material.

3. The slat assembly according to claim 1, wherein the adhesive glue layer is made of a food-used and transparent fastening material.

4. The slat assembly according to claim 1, wherein each of the plurality of support rods has a round column shape.

5. The slat assembly according to claim 1, wherein each of the plurality of support rods has an elongated and flat shape.

6. The slat assembly according to claim 1, wherein the woven fabric has a plurality of layers, adjacent layers of the plurality of layers are connected by a second adhesive glue layer formed there between.

7. The slat assembly according to claim 1, wherein the slat has plurality of holes spaced apart forming a horizontal slat piece.

8. The slat assembly according to claim 1, wherein the slat has a hook hole located on one end forming a vertical slat piece.

* * * * *